United States Patent [19]

Williams

[11] Patent Number: 5,042,696

[45] Date of Patent: Aug. 27, 1991

[54] DISPENSER WITH PISTON ASSEMBLY FOR EXPELLING PRODUCT

[76] Inventor: John E. Williams, 8029 Brimfield Ave., Panorama City, Calif. 91402

[21] Appl. No.: 575,432

[22] Filed: Aug. 30, 1990

Related U.S. Application Data

[63] Continuation-in-part of Ser. No. 517,716, May 2, 1990, which is a continuation-in-part of Ser. No. 438,065, Nov. 20, 1989, abandoned.

[51] Int. Cl.[5] ..... B67D 5/42

[52] U.S. Cl. ..... 222/340; 222/386; 222/386.5; 222/387; 222/389; 222/390

[58] Field of Search ..... 222/94, 95, 105, 131, 222/183, 207, 209, 212, 214, 252, 320, 321, 336, 337, 339-341, 386, 386.5, 387, 389, 390, 394, 398, 402.1

[56] References Cited

U.S. PATENT DOCUMENTS

| | | | |
|---|---|---|---|
| 1,476,946 | 12/1923 | Bessesen | 222/340 |
| 1,664,936 | 4/1928 | Lyman | 222/340 |
| 1,717,672 | 6/1929 | Fitch | 222/340 |
| 1,762,943 | 6/1930 | Zavder | 222/390 X |
| 2,506,833 | 5/1950 | Hunter | 222/340 |
| 2,684,183 | 7/1954 | Werner | 222/340 X |
| 2,728,097 | 12/1955 | Seifert . | |
| 2,738,905 | 3/1956 | Olson | 222/387 |
| 3,195,168 | 7/1965 | Roberts | 401/180 X |
| 3,246,802 | 4/1966 | Fuhrmann | 222/95 |
| 3,613,963 | 10/1971 | Berkmuller | 222/389 |
| 3,815,787 | 6/1974 | Spies | 222/390 X |
| 3,847,304 | 11/1974 | Cohen | 222/387 X |
| 3,951,310 | 4/1976 | Steiman | 222/340 X |
| 4,047,645 | 9/1977 | Caliendo | 222/386.5 |
| 4,077,544 | 3/1978 | Malacheski et al. | 222/340 X |
| 4,220,264 | 9/1980 | Gamadia | 222/207 |
| 4,323,177 | 4/1982 | Nielsen | 222/386 |
| 4,556,156 | 12/1985 | Frutin | 222/389 X |
| 4,907,727 | 3/1990 | Ernst et al. | 222/386.5 |

FOREIGN PATENT DOCUMENTS

| | | | |
|---|---|---|---|
| 1179121 | 5/1959 | France | 222/340 |

*Primary Examiner*—Kevin P. Shaver

*Attorney, Agent, or Firm*—Burns, Doane, Swecker & Mathis

[57] ABSTRACT

A dispenser comprises an inner cylinder defining a contents chamber. A discharge valve is disposed at one longitudinal end of the chamber. A piston assembly disposed in the chamber is displaceable toward the valve for pressurizing the contents of the chamber. The piston includes longitudinally spaced ejector and energizer members with compressible air disposed therebetween for storing and transmitting energy from the energizer member to the ejector member. The air is confined by the sealing action of the ejector and energizer members against the inner cylinder. Alternatively, the air may be contained within a flexible enclosure extending between the ejector and energizer members, in order to avoid migration of air through the inner cylinder.

6 Claims, 4 Drawing Sheets

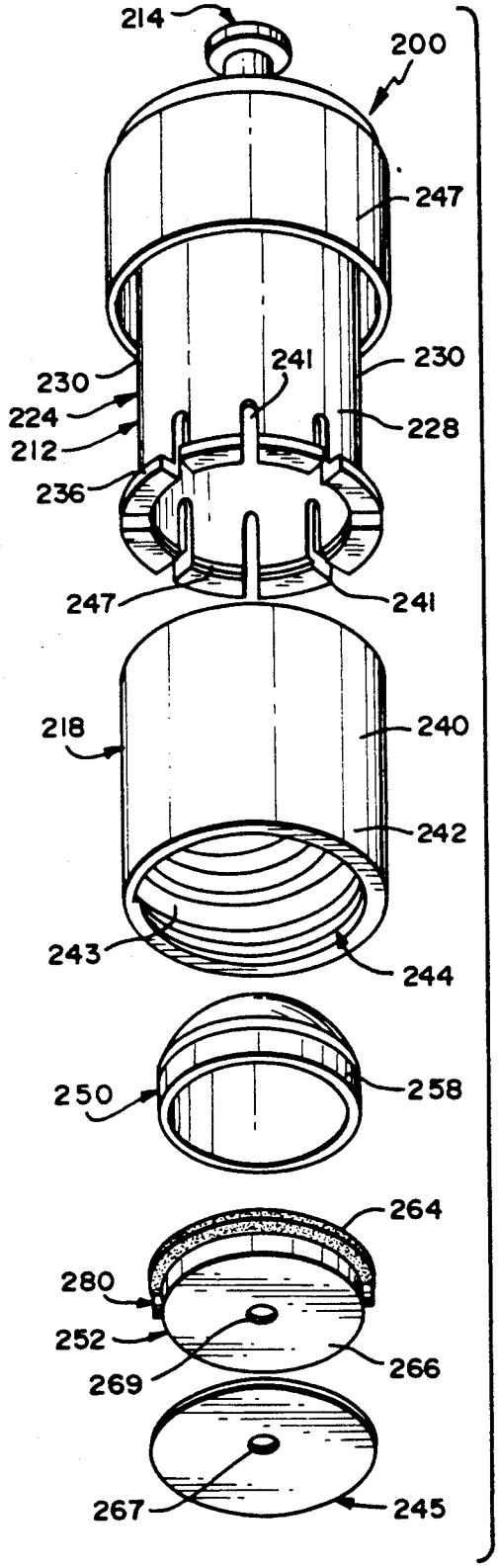
FIG. 2
FIG. 3
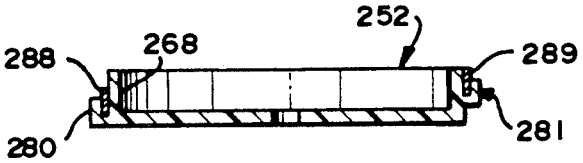
FIG. 4
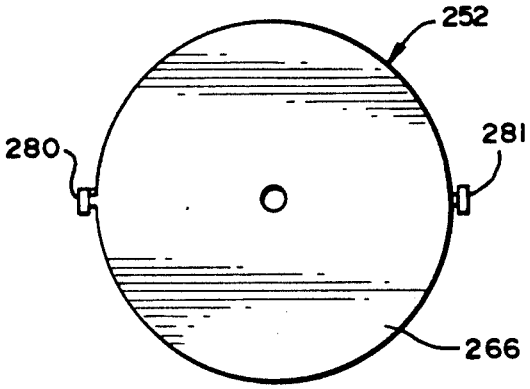
FIG. 5
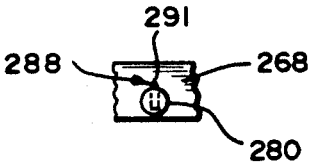
FIG. 6
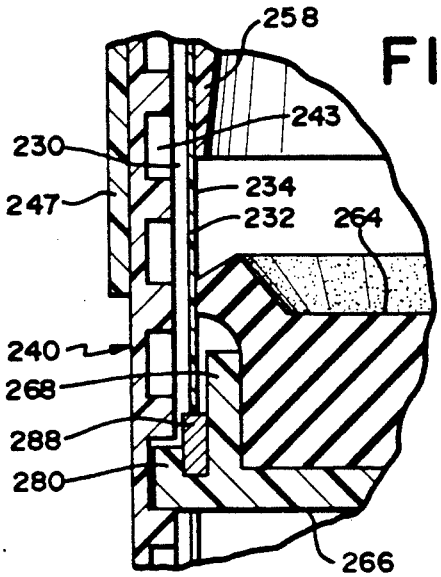

DISPENSER WITH PISTON ASSEMBLY FOR EXPELLING PRODUCT

RELATED INVENTIONS

This is a Continuation-in-Part of U.S. application Ser. No. 07/517,716, filed May 2, 1990 which, in turn, is a Continuation-in-Part of U.S. application Ser. No. 07/438,065 filed Nov. 20, 1989, now abandoned.

BACKGROUND OF THE INVENTION

The present invention relates to a dispenser, especially a hand-held spray can in which a piston is advanced to eject a spray upon manual actuation of a valve.

Hand-held spray dispensers are conventional in which a piston is housed within a container below a product to be dispensed. By advancing the piston toward a valved end of the container, the product is forced through the valve.

In U.S. Pat. No. 3,195,168, an axially threaded rod is provided which extends axially within the container and carries a threaded follower. Disposed above the follower is a piston which seals against the inside surface of the contents chamber. The rod is rotated by means of a knob mounted at the bottom of the container. A spring disposed between the follower and piston transmits motion from the follower to the piston and stores energy. By rotating the rod, the follower and piston are raised to dispense the contents. Although the spring effectively stores energy, it does not transmit the energy to the piston as uniformly across the area of the piston as would be desired, thereby resulting in a less-than-optimum spray pattern.

It would be desirable to provide a relatively low-cost easily assembled, dispenser which makes it possible to store propulsion energy so that a continuous discharge can be effected with a highly uniform spray pattern.

SUMMARY OF THE INVENTION

The present invention relates to a dispenser which comprises a cylindrical wall defining a contents chamber. A discharge valve is disposed at one longitudinal end of the chamber. A piston is disposed within the chamber in longitudinally spaced relationship from the valve. The dispenser includes manually actuable means connected to the piston for displacing the piston toward the discharge valve to pressurized the contents of the chamber. The piston comprises an energizer member and injection member, the latter being disposed between the energizer member and the discharge valve. A compressible gas, preferably air, is sealed between the ejector and energizer members and defines means for storing energy for transmission to the ejector member in response to displacement of the energizer member toward the ejector member.

Preferably, a flexible enclosure, such as a bellows, extends between the ejector and energizer members for defining a chamber containing the compressible gas.

BRIEF DESCRIPTION OF THE DRAWING

The objects and advantages of the invention will become apparent from the following detailed description of preferred embodiments thereof in connection with the accompanying drawings in which like numerals designate like elements, and in which:

FIG. 2 is a perspective exploded view of the dispenser depicted in FIG. 1;

FIG. 3 is a longitudinal sectional view taken through an energizer member of a piston assembly according to the invention;

FIG. 4 is a bottom plan view of the energizer member depicted in FIG. 3;

FIG. 5 is a fragmentary side view of the energizer member;

FIG. 6 is a fragmentary longitudinal sectional view of the dispenser depicted in FIG. 1;

DETAILED DESCRIPTION OF PREFERRED EMBODIMENTS OF THE INVENTION

Figure 1:
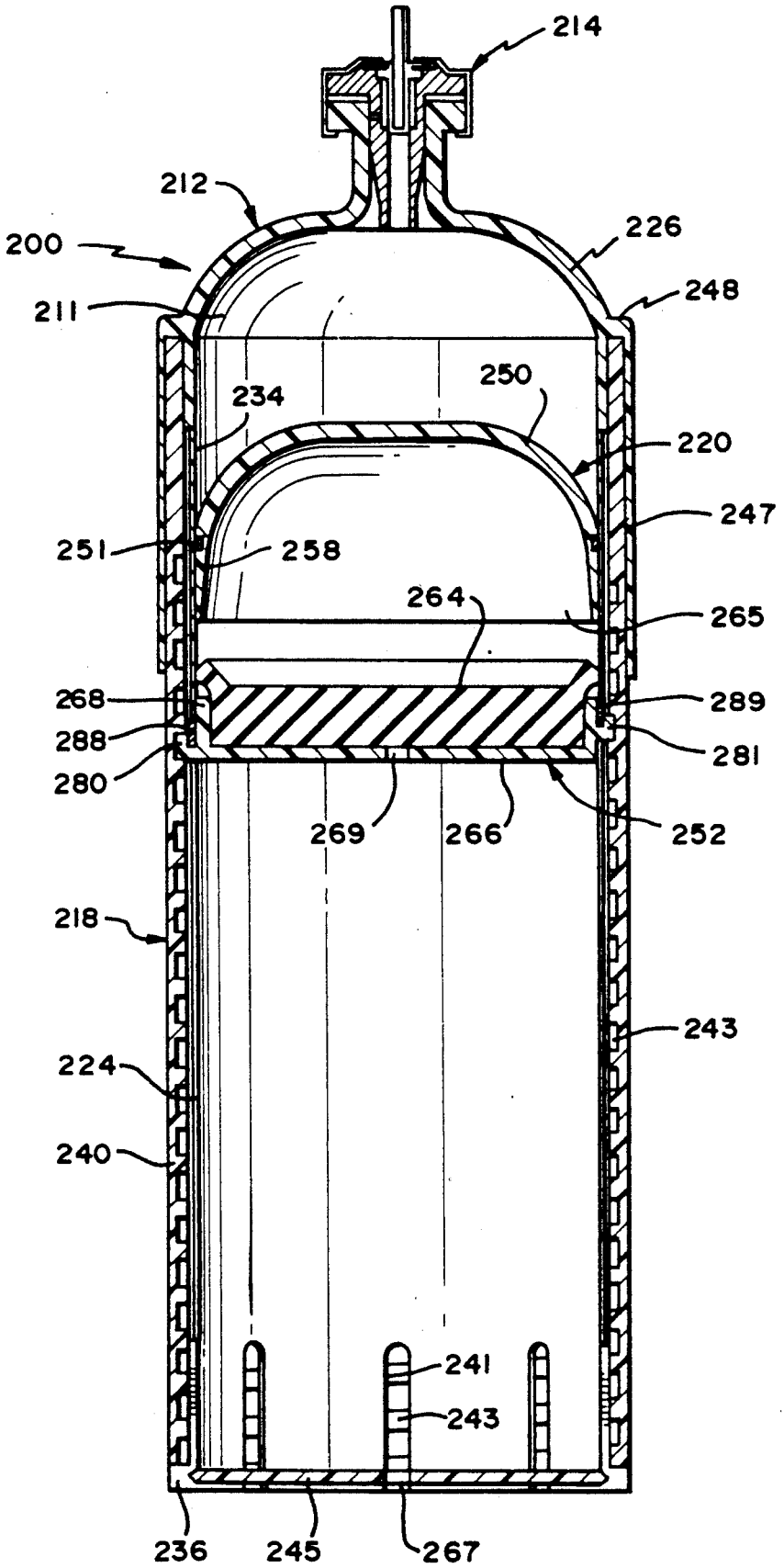
FIG. 1 is a longitudinal sectional view taken through a dispenser according to the present invention.

A dispenser 200 according to the present invention includes a first housing body 212 having a cylindrical wall 224 and an upper end wall 226. Formed in an outer surface 228 of the cylindrical wall 224 are a pair of longitudinal grooves 230 which extend partially through the cylindrical wall from the outside to leave knock-out wall portions 232 (see FIG. 6). An inside surface 234 of the cylindrical wall remains smooth and continuous.

An annular flange 236 projects radially outwardly from a lower end of the outer surface 228. A cylindrical wall 240 of a second housing body 218 rests on the flange 236. That cylindrical wall 240 receives the cylindrical wall 224 in telescoping fashion, whereby the cylindrical walls 224, 240 constitute inner and outer cylindrical walls, respectively. The cylindrical wall 224 includes longitudinally extending, circumferentially spaced slots 241 at its lower end to enable the outer wall 240 to be inserted over the inner wall 224. The outer wall 240 includes inner and outer surfaces 244, 242, respectively. A disk 245 inserted into the inner surface 244 of the cylindrical wall 224 closes the bottom of the first housing body 212. That disk 245 can be suitably bonded to the cylindrical wall 224.

The inner surface 244 includes a helical groove 243 which faces radially inwardly. That groove 243 serves to guide a piston assembly 220, as will be explained. The helical groove 243 is situated radially outwardly of the longitudinal grooves 230, whereby the helical groove 243 constitutes an outer groove and the longitudinal grooves 230 constitute inner grooves.

An upper end of the outer wall 240 is received within an annular channel defined between the inner wall 224 and an outer cylindrical skirt 247 which is joined to the inner wall 224 by an outwardly extending portion 248 of the end wall 226.

The piston assembly 220 comprises an ejector member 250, and an energizer member 252 located below the ejector member 250. The ejector member 250 includes a downwardly extending annular skirt portion 258 which carries an O-ring 251.

The energizer member 252 includes a seal carrier comprising a disk portion 266 and an annular skirt 268 extending upwardly therefrom. Disposed within the skirt 268 is an elastic sealing member 264 which bears sealingly against the inner surface 234 of the inner wall 224. The seal carrier 266, 268 is preferably formed of a stiff plastic material, whereas the elastic sealing member 264 is preferably formed of rubber or a suitably resilient plastic. Alternatively, the seal carrier and the sealing member could be integrally molded of a suitably elastic material.

Formed between the sealing member 264 and the ejector member 250 is a sealed space 265 capable of retaining pressurized air. Pressurization of that space 265 can be achieved by the insertion of a needle through the sealing member 264 after the components of the dispenser have been assembled. Holes 267 and 269 formed in the disks 245 and 266, respectively, accommodate the insertion of the needle. Pressurized air would be introduced through the needle and into the space 266 to pressurize the space to a suitable pressure,, e.g., 40 psi. When the needle is pulled back out of the sealing member, the latter is self-sealing to seal the puncture made by the needle. As will be subsequently explained, the air in the space 265 functions as an air spring to store and transmit the energy.

Projecting radially outwardly from the disk 266 are guide members 280, 281 which are received within the helical groove 243. Carried by the disk 266 are a pair of cutting elements 288, 289 having cutting edges 291 facing longitudinally forwardly toward lower edges of the knock-out wall portions 232 of the inner wall 224. The cutting elements 288, 289, which could be formed of metal or a suitably hard plastic, are initially positioned to lie within diametrically opposed ones of the slots 241. As a result, rotation of the energizer member 252 relative to the inner wall 224 is prevented.

It will be appreciated that the rotation of the outer wall 240 relative to the inner wall 224 in a selected direction produces forward longitudinal movement of the energizer member 252 toward a valve 214 mounted in the upper end wall 226, due to the presence of the guide members 280, 281 within the helical groove 243. As a result, the cutting elements are forced to cut through the knock-out wall portions 232. Simultaneously, an upper force is transmitted from the energizer member 252 to the ejector member 250 through the pressurized air disposed within the space 265. The ejector member 250 thus pressurizes the product located thereabove. When the pressure of the product exceeds the pressure of air in the space 265, further forward movement of the energizer member 252 causes the air to be compressed, thereby storing energy. The air constitutes a gas spring which transmits forces to the ejector member 250 more uniformly than the spring 54 of the earlier described embodiment and thus achieves a more uniform spray through the valve 214.

The pressurized air within the space 265 also forces the skirt 258 of the ejector member radially outwardly against the surface 234 to aid in the sealing action. Such sealing action may be sufficient to enable the O-ring 251 to be omitted.

The upper end wall 226 and the ejector member 250 are of similar inverted cup-shape, to ensure that all of the contents of the container have been dispensed when the energizer member 250 finally engages the end wall 226.

In operation, the user rotates the outer wall 240 to raise the piston assembly and pressurize the contents of the chamber 211 as well as the air in space 265. The energizer member 252 travels longitudinally without rotation as the piston assembly rises. It may be possible to eliminate the longitudinal grooves 230 (i.e., it may be unnecessary to form knock-out wall portions in the inner wall 244) due to the ability of the energizer member 252 to travel longitudinally without such grooves. The longitudinal movement of the piston assembly 220 is induced by the helical groove 243 which acts on the guides 280, 281. That longitudinal movement of the piston assembly is made possible by the cutting action of the cutting elements 288, 289. The contents will be expelled under their own pressure as well as under the pressure of stored air energy within the space 265, whereafter the piston assembly will be further raised to repressurize the contents and the air space 265. The portion of the surface 234 which engages the contents can be made smooth and continuous, i.e., free of grooves, whereby leakage of the contents and/or rupturing of a bag which contains the contents can be prevented.

It will be appreciated that the piston assembly could be raised and lowered by any suitable manually actuable mechanism.

Figure 7:
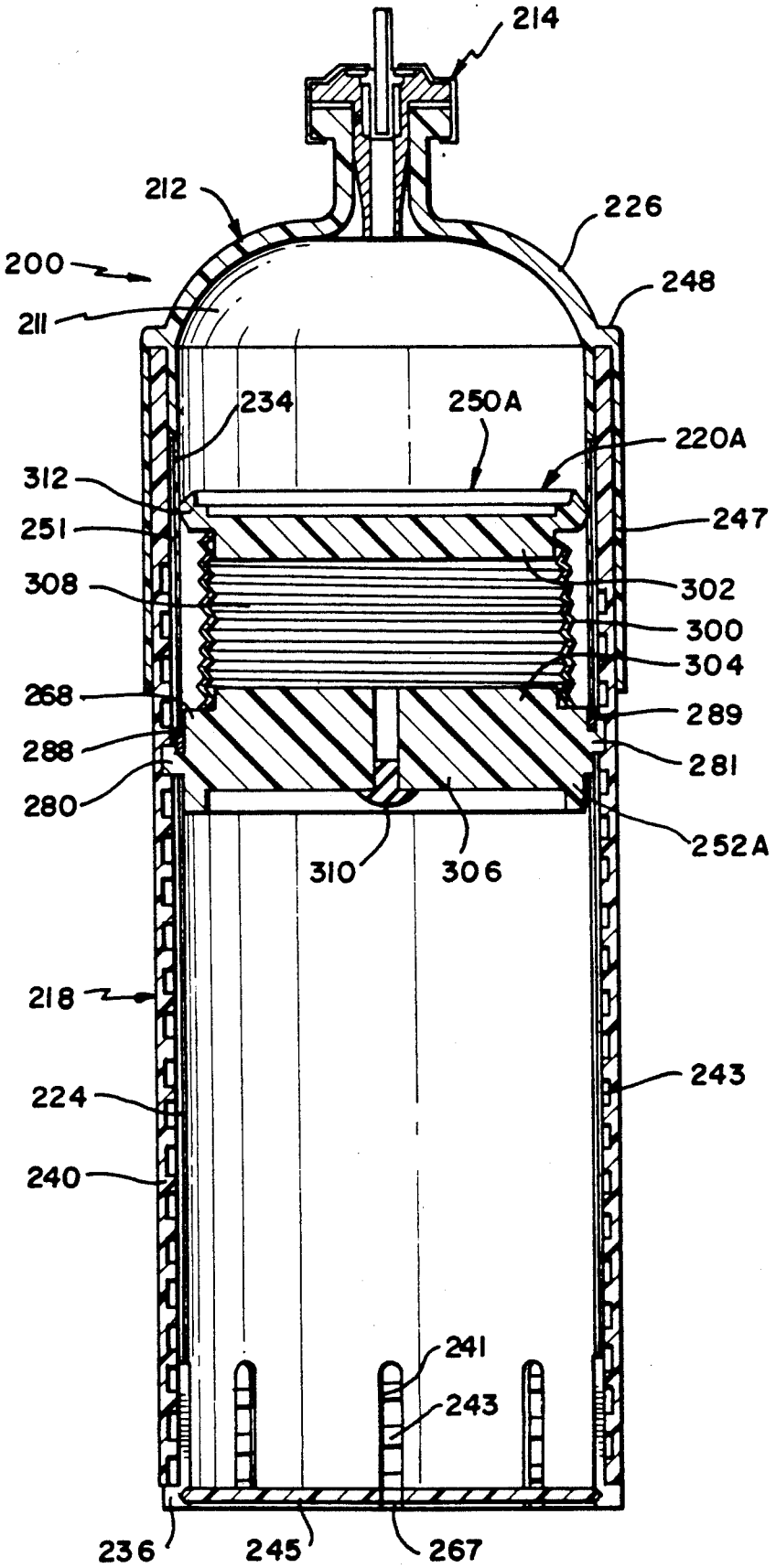
FIG. 7 is a view similar to FIG. 1 of a modified piston assembly according to the invention.
Figure 8:
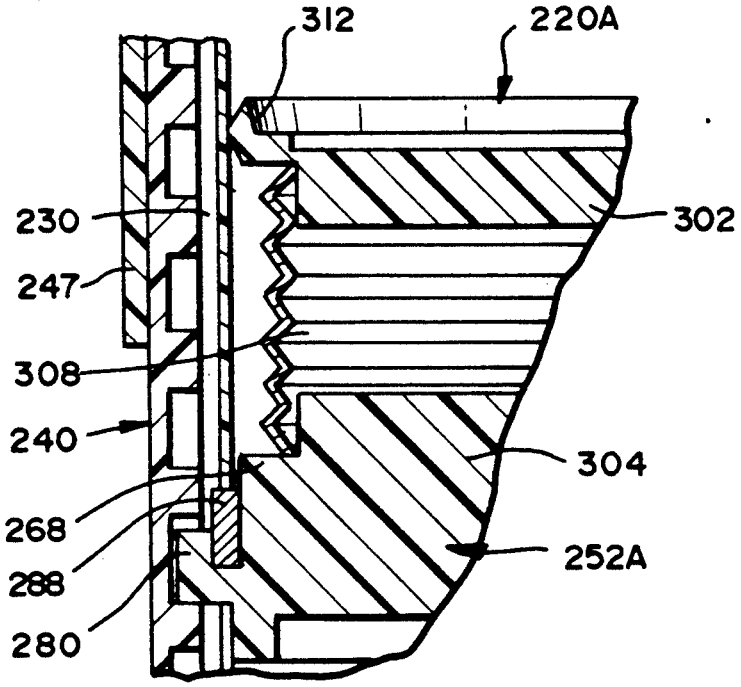
FIG. 8 is a view similar to FIG. 6 of the piston assembly depicted in FIG. 7.

A modified embodiment of the piston assembly is depicted in FIGS. 7 and 8. That modified piston assembly 220A prevents the air situated between the ejector member 250A and the energizer member 252A from escaping past the energizer and/or ejector members or migrating through the housing wall(s) of the dispenser, as might occur over a period of time in connection with certain plastic materials from which the housing walls could be formed. Such migration of air would eventually destroy the air spring properties of the piston assembly.

In accordance with the present invention, however, the air is retained between the ejector member 250A and the energizer member 252A by means of a flexible enclosure 300. The enclosure is preferably in the form of a bellows formed of a suitable plastic or rubber material which is connected in an air-tight manner at its upper end to a cylindrical projection 302 of the ejector member 250A and at its lower end to a cylindrical projection 304 of the energizer member 252A.

The energizer member 252A is of a more simplified structure as compared with that of the earlier disclosed embodiment, because the confining of air within the bellows 300 makes it unnecessary for the energizer member to form a seal with the surface 234 of the cylindrical wall 224. The energizer member 252A includes a passage 306 for enabling an inner chamber 308 defined by the bellows to be filled with air by means of a syringe, for example. The syringe could be inserted through a self-sealing rubber plug 310 disposed at the lower end of the passage.

The ejector member 250A includes a sealing portion 312 which forms a seal against the surface 234 as the piston is raised to pressurize the contents of the dispenser.

Since the compressible air of the piston assembly is contained within the bellows 300, the air will not contact the wall of the dispenser and thus will not be able to migrate therethrough or escape past the energizer and/or ejector members. Hence, the piston assembly 220A is useful with all dispensers, regardless of the materials from which the cylinder wall is formed.

In operation, as the outer valve 240 is rotated to raise the energizer member 252A, the air within the bellows 300 is compressed, and the bellows itself collapses. As the product is dispensed, the ejector member 250A rises, thereby relieving the air pressure within the bellows chamber 308 and causing the bellows to re-expand.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A dispenser comprising cylindrical wall means defining a contents chamber, discharge valve means disposed at one longitudinal end of said chamber, piston means disposed in said chamber in longitudinally spaced relationship from said discharge valve means, and manually actuable means operably connected to said piston means for displacing said piston means toward said discharge valve to pressurize the contents of the chamber, said piston means comprising an energizer member and an ejector member, the latter disposed between said energizer member and said discharge valve means, and compressible gas sealed between said ejector and energizer members and defining means for storing energy for transmission to said ejector member in response to displacement of said energizer member toward said ejector member.

2. A dispenser according to claim 1 including a flexible enclosure extending between said ejector and energizer members and defining a chamber containing said compressible gas.

3. A dispenser according to claim 2, wherein said enclosure comprises a bellows.

4. A dispenser according to claim 1, wherein said compressible gas is air.

5. A dispenser according to claim 1, wherein said energizer member includes an elastic seal for sealing against an inner surface of said cylindrical wall means.

6. A dispenser according to claim 5, wherein said ejector member includes a skirt arranged to be pressed radially against said inner surface by compressed air between said ejector and energizer members.

* * * * *